United States Patent [19]

Lindblom

[11] 4,217,790

[45] Aug. 19, 1980

[54] RESILIENT LINK APPARATUS

[75] Inventor: Victor E. Lindblom, Peoria, Ill.

[73] Assignee: Caterpillar Tractor Co., Peoria, Ill.

[21] Appl. No.: 955,866

[22] Filed: Oct. 30, 1978

[51] Int. Cl.[2] ..... G05G 1/00

[52] U.S. Cl. ..... 74/470; 403/109

[58] Field of Search ..... 74/470; 403/109

[56] References Cited

U.S. PATENT DOCUMENTS

| | | | |
|---|---|---|---|
| 1,304,955 | 5/1919 | Fowler | 74/470 X |
| 1,630,199 | 5/1927 | Megnin | 74/470 X |
| 2,071,785 | 2/1937 | Ehrlich | 74/470 X |
| 2,400,633 | 5/1946 | Derungs | 74/473 |
| 3,188,878 | 6/1965 | Chelminski et al. | 74/470 |
| 3,343,858 | 9/1967 | Rice | 287/119 |
| 4,059,025 | 11/1977 | Waack et al. | 74/470 X |

*Primary Examiner*—Allan D. Herrmann

*Attorney, Agent, or Firm*—William B. Heming

[57] ABSTRACT

An apparatus or resilient link (24) provides relative movement of first and second members (36,38) for resiliency in limiting forces applied through the link (24). The link (24) connects, for example, a controlling member (14) such as a lever (14) or handle and a work mechanism (10) such as a valve (12) or shifting mechanism. In the resilient link (24), a first apparatus (44) moves the first member (36) from a first toward a second position (46,48) in response to exerting a first force ($F_1$) on the first member (36) in the first direction (50) for resiliency to excessive force applied in tension on the link (24). A second apparatus (52) moves a second member (38) from a first toward a second position (54,56) in response to exerting a second force ($F_2$) on the first member (36) in the second direction (58) for resiliency to excessive force applied in compression on the link (24).

9 Claims, 3 Drawing Figures

14
19
18
88
68
30
94
F1
42
74
38
54
78
66
28
64
48
32
26
72
92
50
34
55
70
36
47
76
66
12
19'

12
20'
F2
42
94
30
74
56
38
70
78
34
68
55
64
28
46
36
66
32
47
76
64
26
72
58
14
18
20
90
92

RESILIENT LINK APPARATUS

TECHNICAL FIELD

The invention relates to a resilient link apparatus limiting force rigidly transmitted from a controlling member such as a control lever or handle to a work mechanism such as a valve or shifting mechanism. More particularly, the invention relates to first means for moving a first member in response to exerting a first force in a first direction on the first member and second means for moving a second member in response to exerting a second force in an opposite second direction on the second member for providing resiliency in the normally rigid resilient link owing to movement of the first member relative to the second member.

BACKGROUND ART

In the use of a resilient link apparatus, it is desirable to provide separate means each imparting resiliency to a normally rigid control system in a respective one of first and second directions for convenience in assembly and use of differing force limits for resiliency in a respective direction.

The invention relates to first means, for example, a first spring, for moving a first member in response to exerting a first force in a first direction on said first member. Said first means thereby provides resiliency in response to the resilient link being under tension. Second means, for example, a second spring, is provided for moving a second member in response to a second force in a second direction on said second member. Said second means provides resiliency in response to the resilient link being under compression. The resiliency results from relative movement of the first and second members.

U.S. Pat. No. 2,400,633, which issued on May 21, 1946, to Derungs, discloses a resilient coupling device having a single spring means to control resiliency in response to forces of equal magnitude applied in tension and compression on the coupling device.

U.S. Pat. No. 3,343,858, which issued on Sept. 26, 1967 to Rice, discloses a resilient link having a single spring means providing resiliency in response to one of the components connected to the link not being movable by a predetermined force.

A resilient link apparatus is generally used on cable or arm control systems to prevent damage to the system from the application of excessive force through the control cable or arm. For example, a control cable is connected at one end to a control valve. A control lever is connected at the other end. The lever is used to push or pull the cable and change control positions of the valve. Push-pull cable assemblies generally require fine adjustments to synchronize movement of the control lever with that of the valve. Travel stops are necessary in each direction of travel of the control lever to prevent over travel of system components owing to application of excessive force to the control handle.

The fine adjustments necessary to synchronize the lever movement relative to the stops and full travel of the valve are time consuming and sometimes change during operation of the vehicle, especially under harsh operating conditions. A resilient link is incorporated into the controls to reduce the importance of fine adjustments and close tolerances in the stops and lever control.

The resilient link normally transmits forces rigidly through the control cable. However, if the force on the cable reaches a preselected magnitude, the resilient link provides relative movement of cable portions to prevent damage in response to the excessive force. Heretofore, resilient link construction has not permitted convenient servicing of components to change the operating characteristics of the link. The use of separate force limits of resiliency in tension and compression on the cable has also been unavailable. This is needed to accommodate use of, for example, a spring assisted valve in which the force exerted through the cable to move the valve in one direction is different from the force moving the valve in the opposed direction.

Therefore, it is desirable to provide first and second means each adjustable and controlling the deflection on the resilient link in response to a respective one of applied force in tension and in compression on the link and control system.

DISCLOSURE OF INVENTION

An apparatus has a housing, first and second members and first and second means. The housing has first, second and third walls and first and second cavities. The first and second walls define the first cavity. The second and third walls define the second cavity. Said first and second members are positioned in the first and second cavities, respectively. The first means moves the first member between a first position at which said first member is immediately adjacent and in contactable relationship with the second wall and a second position at which said first member is spaced from said second wall. The first member is moved toward the second position in response to exerting a first force in a first direction on said first member. The second means moves the second member between a first position at which said second member is immediately adjacent and in contactable relationship with the third wall and a second position at which said second member is spaced from said third wall. The second member is moved toward the second position in response to exerting a second force in a second direction on said first member.

A resilient link apparatus provides resiliency and prevents overloading a control system in response to exerting excessive force on the control system. In the apparatus, the first means controls resiliency in response to exerting forces in tension on the apparatus. The second means controls resiliency in response to exerting forces in compression on the apparatus. Said first and second means are separately changeable for altering associated control system characteristics and defining differing force limits of resiliency in tension and compression.

BEST MODE FOR CARRYING OUT THE INVENTION

Figure 1:
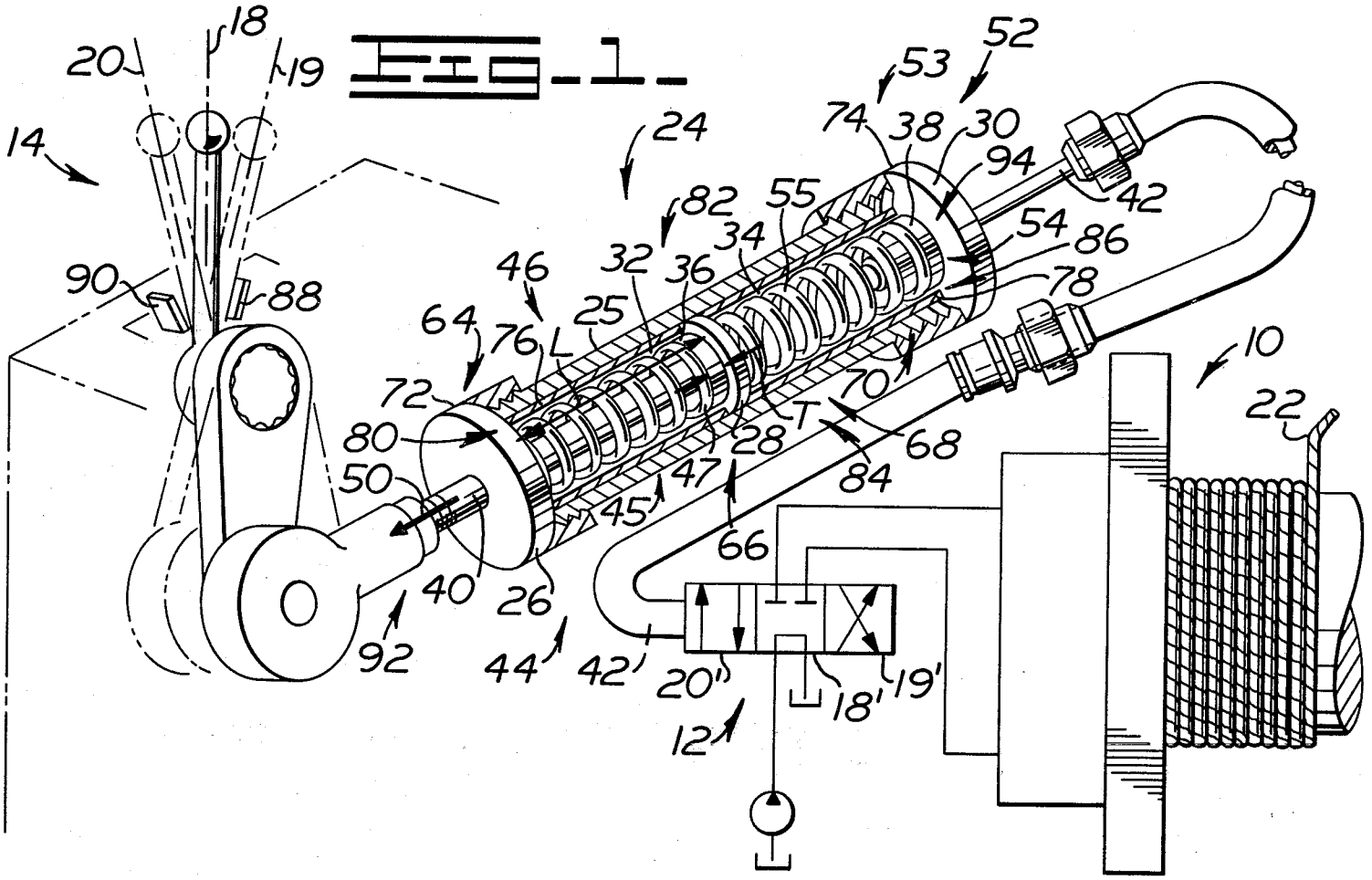
FIG. 1 is a diagrammatic perspective view of an embodiment of the invention connecting a controlling member and work mechanism.

Referring to the drawings, a work mechanism 10 shown, for example, as a winch 10 has a valve 12 and is associated with a controlling member 14. The controlling member 14 is a control lever 14 that is movable between first, second and third positions 18,19,20 for moving the valve 12 between first, second and third positions 18',19',20', respectively.

The first position 18' of the valve 12 represents the neutral position 18'. In moving the valve 12 between the first and second positions 18', 19', fluid flow is controllable in order to release cable 22 from the winch 10 at varying speeds. In moving the valve 12 between the first and third positions 18',20', the cable 22 can be recovered on the winch 10. Such winch controls and operation are well known in the art.

Figure 2:
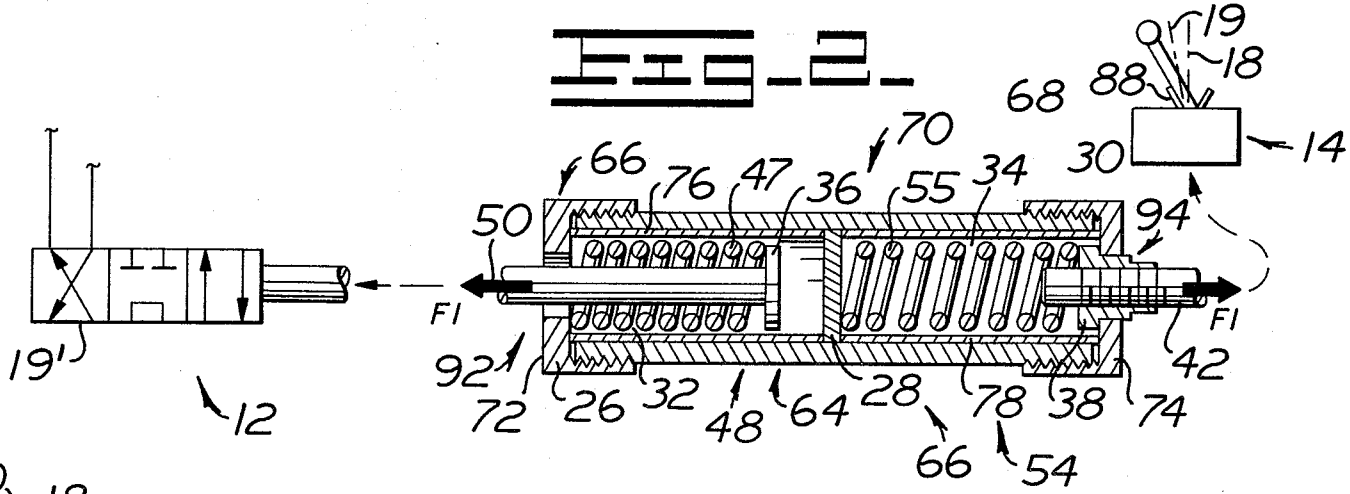
FIG. 2 is a diagrammatic view of another embodiment of the invention showing the invention in greater detail.
Figure 3:
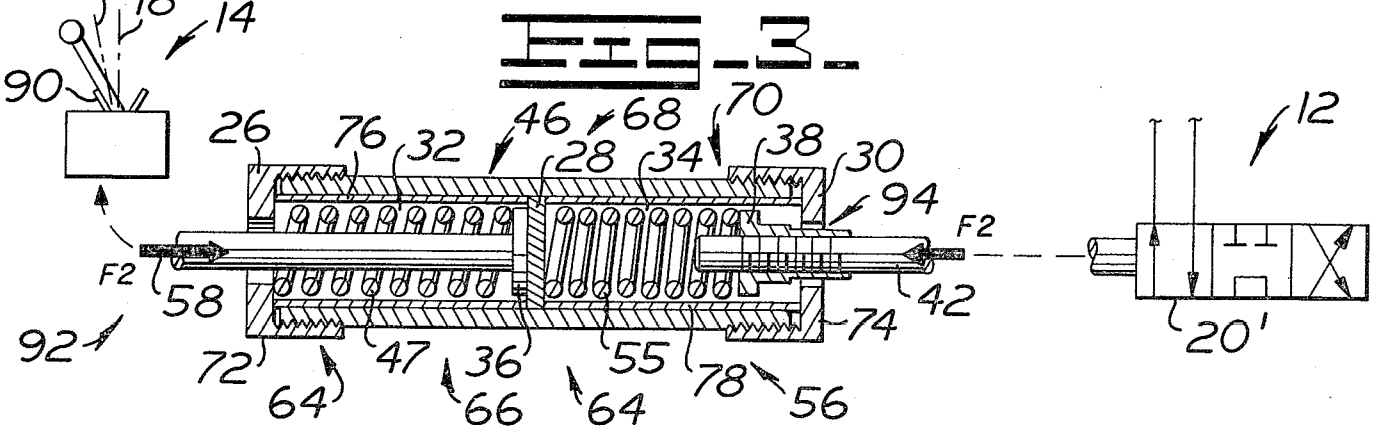
FIG. 3 is a diagrammatic view of the embodiment of FIG. 1 showing the invention in still greater detail.

An apparatus or resilient link 24 connects the winch 10 to the control lever 14. A housing 25 of said resilient link 24 has first, second and third walls 26,28,30 and first and second cavities 32,34. The first and second walls 26,28 define the first cavity 32. The second and third walls 28,30 define the second cavity 34. First and second members 36,38 are positioned in the first and second cavities 32,34, respectively. First and second control elements 40,42 shown, for example, as first and second cable portions 40,42, are each connected to a respective one of the control lever 14 and valve 12 and to a respective one of the first and second members 36,38. In FIGS. 1 and 3, the first cable portion 40 is connected to the first member 36 and the control lever 14. Said cable portions 40,42 are shown reversed in FIG. 2.

First means 44, which is, for example, a first biasing means 45 such as a first spring 47, is provided for moving the first member 36 in the first cavity 32 between first (FIGS. 1 and 3) and second (FIG. 2) positions 46,48. At the first position 46, the first member 36 is immediately adjacent and in contactable relationship with the second wall 28. At the second position 48, said first member 36 is spaced from the second wall 28 and said first position 46. The first member 36 is moved toward the second position 48 in response to exerting a first force $F_1$ of a preselected magnitude on said first member 36 in a first direction 50 (FIG. 2). In other words, the first spring 47 provides resiliency owing to the first member 36 moving in response to the first force $F_1$ overcoming the resistant spring force.

Second means 52, which is, for example, a second biasing means 53 such as a second spring 55, is provided for moving the second member 38 in the second cavity 34 between first (FIGS. 1 and 2) and second (FIG. 3) positions 54,56. At said first position 54, the second member 38 is immediately adjacent and in contactable relationship with the third wall 30. At said second position 56, the second member 38 is spaced from the third wall 30 and said first position 54. Said second member 38 is moved toward the second position 56 in response to exerting a second force $F_2$ of a preselected magnitude on the first member 36 in a second direction 58 (FIG. 3). The second direction 58 is opposite the first direction 50. In other words, the second spring 55 provides resiliency owing to the second member 38 moving in response to the second force $F_2$ overcoming the resistant force of the second spring 53.

The first and second cable portions 40,42 are of a construction sufficient for exerting said first and second forces $F_1$,$F_2$ in response to moving the control lever 14. It should be understood that the cable portions 40,42 can be of other configurations as is known in the art without departing from the invention.

The first spring 47 has first and second ends 64,66 and is positioned in the first cavity 32. Said first end 64 is contactable with one of the first wall 26 and first member 36. Said second end 66 is contactable with the other of the first wall 26 and first member 36. The first end 64 is shown in contactable relationship with the first wall 26 in FIGS. 1 and 3. Said ends 64,66 are reversed in FIG. 2.

The second spring 55 has first and second ends 68,70 and is positioned in the second cavity 34. Said first end 68 is contactable with one of the second wall 28 and second member 38. Said second end 70 is contactable with the other of the second wall 28 and second member 38. The first end 68 is shown in contactable relationship with the second wall 28 in FIGS. 1 and 3. Said ends 68,70 are reversed in FIG. 2.

In the preferred embodiment, the first spring 47 continuously biases the first member 36 at a first preselected rate. The first member 36 is in contact with the second wall 28 at the first position 46. Thus, said first spring 47 is in a preloaded condition in the first cavity 32. The second spring 55 continuously biases the second member 38 at a second preselected rate. The second member 38 is in contact with the third wall 30 at the first position 54. Said second spring 55 is also under a preloaded condition in the second cavity 34.

Each of the first and second biasing means 45,53 or springs 47,55 has a preselected biasing constant. Said preselected biasing constants can be different one from the other. The first preselected rate can be different from the second preselected rate to provide the first spring 47 with a preloaded condition different from the second spring 55.

Further referring to the preferred embodiment, the housing 25 has first and second cap portions 72,74 and first and second spacers 76,78. Said first cap portion 72 defines the first wall 26. Said second cap portion 74 defines the third wall 30. The cap portions 72,74 are moveably connected to the housing 25 in a manner sufficient for controllably changing the length of the first and second cavities 32,34, respectively. As is shown, the cap portions 72,74 are threadably connectable to respective ends of the housing 25 and can be reversed.

The spacers 76,78 each have a preselected length and first and second ends 80,82,84,86. Said first spacer 76 is positioned in the first cavity 32 and contactable at the first end 80 with one of the first and second walls 26,28 and at the second end 82 with the other of said walls 28,26. The second spacer 78 is positioned in the second cavity 34 and contactable at the first end 84 with one of the second and third walls 28,30 and at the second end 86 with the other of said second and third walls 30,28. As shown, said spacers 76,78 are cylindrical in shape and have an opening through which the related one of the springs 47,55 passes. Said spacers 72,74 can be reversed.

The cap portions 72,74 are threadably moveable on the housing 25 for contacting the related ends of the respective spacers 76,78. The lengths of the cavities 32,34 are thereby controllably definable relative to preselected lengths of the respective spacers 76,78. The preloaded condition of the first spring 47, for example, is controllable by the preselected length, L, of the first spacer 76 and a preselected thickness, T, of the first member 36 (FIG. 1). The preloaded condition of the second spring 55 is similarly controllable.

In the embodiment shown, the first and second members 36,38 fit under close tolerance within the respective spacers 76,78. The spacers 76,78 fit under close tolerance within the respective cavities 32,34 of the housing 25. The result is to maintain the springs 47,55 in a preselected longitudinal orientation while under changing compressive forces.

The resilient link 24 is easily adjustable and serviceable owing to the relationship of the cap portions 72,74, spacers 76,78, and springs 47,55 to the operation of said resilient link 24. It should be understood that said housing 25, spacers 76,78, and first and second means 44,52 can be of other configurations as is known in the art without departing from the invention.

INDUSTRIAL APPLICABILITY

In the use of the resilient link 24, said link 24 rigidly transmits forces in tension of magnitudes lesser than the preselected magnitude of the first force $F_1$ and forces in compression of magnitudes lesser than the preselected magnitude of the second force $F_2$. If the resilient link 24 is under tension, force acts in the first direction 50 on the first member 36 urging said first member 36 against the first spring 47 and acts on the second member 38 urging said second member 38 against the third wall 30 to rigidly transmit the force (FIG. 1). When the force on said link 24 reaches the preselected magnitude, the first member 36 compresses the first spring 47 and moves relative to the second member 38 to substantially reduce the effects of exerting excessive force on the related components (FIG. 2). If the resilient link 24 is under compression, the second member 38 similarly compresses the second spring 55 to provide resiliency in the control of the winch 10 (FIG. 3).

For example, the control lever 14 is moved from the first position 18 toward the second position 19 to reel out the cable 22 on the winch 10. In moving the control lever 14 in the embodiment of FIG. 1, a force is applied on the first cable portion 40 urging the first member 36 against the first spring 47. The force is carried through the first spring 47 and housing 25 to the second member 38 and second cable portion 42 for rigidly transmitting the force and moving the valve 12 toward the second position 19'. The result is to place the resilient link 24 under compressive force. The force is applied in the first direction 50 on the first member 36.

At the second position 19 of the control lever 14, the valve 12 is fully opened at the respective second position 19'. Owing to manufacturing tolerances and adjustment, the control lever 14 often does not reach a first stop 88 at the second position 19' of the valve 12. An operator tends to exert excessive force on the lever 14 to take advantage of the additional travel space to more fully open the valve 12. The excessive force tends to overload the control components which lead to immediate damage or early deterioration.

However, in the apparatus of this invention, the resilient link 24 deflects in order to prevent overloading. In attempting to move the valve 12 past the limit of movement, the force applied on the first member 36 reaches the preselected magnitude of the first force $F_1$. The first member 36 overcomes the first spring 47 and moves toward the second position 48 and relative to the second member 38. Subsequent movement of the control lever 14 progressively deflects the first spring 47 until the first stop 88 is reached (FIG. 2). The relative movement of the first and second members 36, 38 provides resiliency in the controlling movements of the first and second cable portions 40,42 and prevents the force on the control lever 14 from being rigidly and sometimes damagingly transmitted to the valve 12.

The deflection of the first spring 47, initially in a preloaded condition, is initiated with little increase in force relative to the force necessary to actuate the valve 12. The preload must, however, be of a value sufficient to reliably permit actuation of the valve 12.

Similarly, movement of the control lever 14 toward the third position 20 exerts a compressive force on the resilient link 24 in the second direction 58. In moving the control lever 14 past the third position 20 and toward a second stop 90, the second member 38 tends to deflect the second spring 62 and provide resiliency in the controls (FIG. 3).

The relatively large deflection of the first and second springs 47,55 in relationship to overtravel of the control lever 14 reduces the importance of fine adjustments in the cable portions 40,42 and close tolerances in the control lever stops 88,90. Necessary adjustments can be conveniently made at cable connections 92,94 related to the resilient link 24. Further, use of the first and second springs 47,55 permits different force limits in tension and compression on the resilient link 24. The link 24 can, therefore, be used with spring assisted work mechanisms in which the force exerted through a cable to move the work mechanism in one direction is different from the force moving the work mechanism in the opposed direction.

Other aspects, objects and advantages of this invention can be obtained from a study of the drawings, the disclosure and the appended claims.

What is claimed is:

1. An apparatus (24), comprising:

a housing (25) having first, second and third walls (26,28,30) and first and second cavities (32,34), said first and second walls (26,28) defining the first cavity (32), said second and third walls (28,30) defining the second cavity (34);

first and second members (36,38) positioned in the first and second cavities (32,34), respectively;

first means (44) for moving the first member (36) in the first cavity (32) between a first position (46) at which said first member (36) is immediately adjacent and in contactable relationship with the second wall (28) and a second position (48) at which said first member (36) is spaced from said second wall (28), said first member (36) being moved toward the second position (48) in response to exerting a first force ($F_1$) of a preselected magnitude on said first member (36) in a first direction (50);

second means (52) for moving the second member (38) in the second cavity (34) between a first position (54) at which said second member (38) is immediately adjacent and in contactable relationship with the third wall (30) and a second position (56) at which said second member (38) is spaced from said third wall (30), said second member (38) being moved toward the second position (56) in response to exerting a second force ($F_2$) of a preselected magnitude on the first member (36) in a second direction (58), said second direction (58) being opposite said first direction (50).

2. The apparatus (24), as set forth in claim 1, wherein the first and second means (44,52) are first and second biasing means (45,53), respectively, said first and second biasing means (45,53) each having a preselected biasing constant.

3. The apparatus (24), as set forth in claim 2, wherein said first biasing means (45) is a first spring (47) having first and second ends (64,66) and being positioned in said first cavity (32), said first end (64) being contactable with one of the first wall (26) and first member (36), said second end (66) being contactable with the other of the first wall (26) and first member (36) and said second biasing means (53) is a second spring (55) having first and second ends (68,70) and being positioned in the second cavity (34), said first end (68) being contactable with one of the second wall (28) and second member (38), said second end (70) being contactable with the other of the second wall (28) and second member (38).

4. The apparatus (24), as set forth in claim 3, wherein the first spring (47) continuously biases said first member (36) at a first preselected rate in contact with the second wall (28) at the first position (50) of said first member (36) and the second spring (55) continuously biases said second member (38) at a second preselected rate in contact with the third wall (30) at the first position (54) of said second member (38).

5. The apparatus (24), as set forth in claim 4, wherein said first preselected rate is different from said second preselected rate.

6. The apparatus (24), as set forth in claim 4, wherein the housing (25) has first and second cap portions (72,74) defining said first and third walls (26,30), respectively, and moveably connected to the housing (25) in a manner sufficient for controllably changing the length of the first and second cavities (32,34), respectively.

7. The apparatus (23), as set forth in claim 6, including a first spacer (76) having a preselected length (L) and first and second ends (80,82) and being removably positioned in the first cavity (32), said first end (80) being contactable with one of the first and second walls (26,28), said second end (82) being in contact with the other of the first and second walls (28,26) and a second spacer (78) having a preselected length and first and second ends (84,86) and being removably positioned in the second cavity (34), said first end (84) being contactable with one of the second and third walls (28,30), said second end (86) being contactable with the other of the secnd and third walls (30,28).

8. An apparatus (24), comprising:

a housing (25) having first, second and third walls (26,28,30), first and second cap portions (72,74) and first and second cavities (32,34), said first and second cap portions (72,74) defining said first and third walls (26,30), respectively, and being moveably connected to said housing (25) in a manner sufficient for controllably changing the length of the first and second cavities (32,34), respectively, said first and second walls (26,28) defining the first cavity (32), said second and third walls (28,30) defining the second cavity (34);

first and second members (36,38) positioned in the first and second cavities (32,34), respectively;

a first spring (47) positioned in the first cavity (32) in a manner sufficient for moving the first member (36) between a first position (46) at which said first spring (47) continuously biases said first member (36) at a first preselected rate in contact with the second wall (28) and a second position (48) at which said first member (36) is spaced from said second wall (28), said first member (36) being moved toward the second position (48) in response to exerting a force ($F_1$) of a preselected magnitude in a first direction (50) on said first member (36); and a second spring (55) positioned in the second cavity (34) in a manner sufficient for moving the second member (38) between a first position (54) at which said second spring (53) continuously biases said second member (38) at a second preselected rate in contact with the third wall (30) and a second position (56) at which said second member (38) is spaced from said third wall (30), said second member (38) being moved toward the second position (56) in response to exerting a force ($F_2$) of a preselected magnitude in a second direction (58) on the first member (36), said second direction (58) being opposite said first direction (50).

9. An apparatus (24), comprising:

a controlling member (14);

a work mechanism (10);

a housing (25) having first, second and third walls (26,28,30) and first and second cavities (32,34), said first and second walls (26,28) defining the first cavity (32), said second and third walls (28,30) defining the second cavity (34);

first and second members (36,38) positioned in the first and second cavities (32,34), respectively;

first means (44) for moving the first member (36) in the first cavity (32) between a first position (46) at which said first member (36) is immediately adjacent and in contactable relationship with the second wall (28) and a second position (48) at which said first member (36) is spaced from said second wall (28), said first member (36) being moved toward the second position (48) in response to exerting a first force ($F_1$) of a preselected magnitude in a first direction (50) on said first member (36);

second means (52) for moving the second member (38) in the second cavity (34) between a first position (54) at which said second member (38) is immediately adjacent and in contactable relationship with the third wall (30) and a second position (56) at which said second member (38) is spaced from said third wall (30), said second member (38) being moved toward the second position (56) in response to exerting a second force ($F_2$) of a preselected magnitude in a second direction (58) on the first member (36), said second direction (58) being opposite said first direction (50); and first and second control elements (40,42) each being connected to a respective one of the first and second members (36,38) and a respective one of the controlling member (14) and work mechanism (10) and being of a construction sufficient for exerting said first and second forces in response to moving the controlling member (14).

* * * * *